US008307469B1

(12) United States Patent
Cohen

(10) Patent No.: US 8,307,469 B1
(45) Date of Patent: Nov. 13, 2012

(54) REMOVABLE FLOOR SINK DRAIN LOCK

(75) Inventor: Todd Cohen, Chatsworth, CA (US)

(73) Assignee: TNT Products, LLC, Chatsworth, CA (US)

( * ) Notice: Subject to any disclaimer, the term of this patent is extended or adjusted under 35 U.S.C. 154(b) by 128 days.

(21) Appl. No.: 12/387,030

(22) Filed: Apr. 28, 2009

Related U.S. Application Data

(60) Provisional application No. 61/131,136, filed on Jun. 6, 2008.

(51) Int. Cl.
*A47K 1/14* (2006.01)
*E03C 1/26* (2006.01)

(52) U.S. Cl. ..... 4/286; 4/288; 4/292; 4/652

(58) Field of Classification Search ..... 4/286, 288–292, 4/652
See application file for complete search history.

(56) References Cited

U.S. PATENT DOCUMENTS

| | | | | | |
|---|---|---|---|---|---|
| 962,577 | A | * | 6/1910 | Mueller | 4/288 |
| 1,059,748 | A | * | 4/1913 | Mueller et al. | 4/288 |
| 2,225,693 | A | * | 12/1940 | Frances | 4/291 |
| 3,800,339 | A | * | 4/1974 | Bergin | 4/286 |
| 4,006,498 | A | * | 2/1977 | Cuschera | 4/286 |

* cited by examiner

*Primary Examiner* — Tuan N Nguyen
(74) *Attorney, Agent, or Firm* — Feldman Gale, P.A.; Gregory B. Wood

(57) ABSTRACT

Improved floor sink drain screen locks having expandable means for sealingly engaging the walls of a floor sink drain, yet being readily collapsible for quick and easy removal when desired.

7 Claims, 1 Drawing Sheet

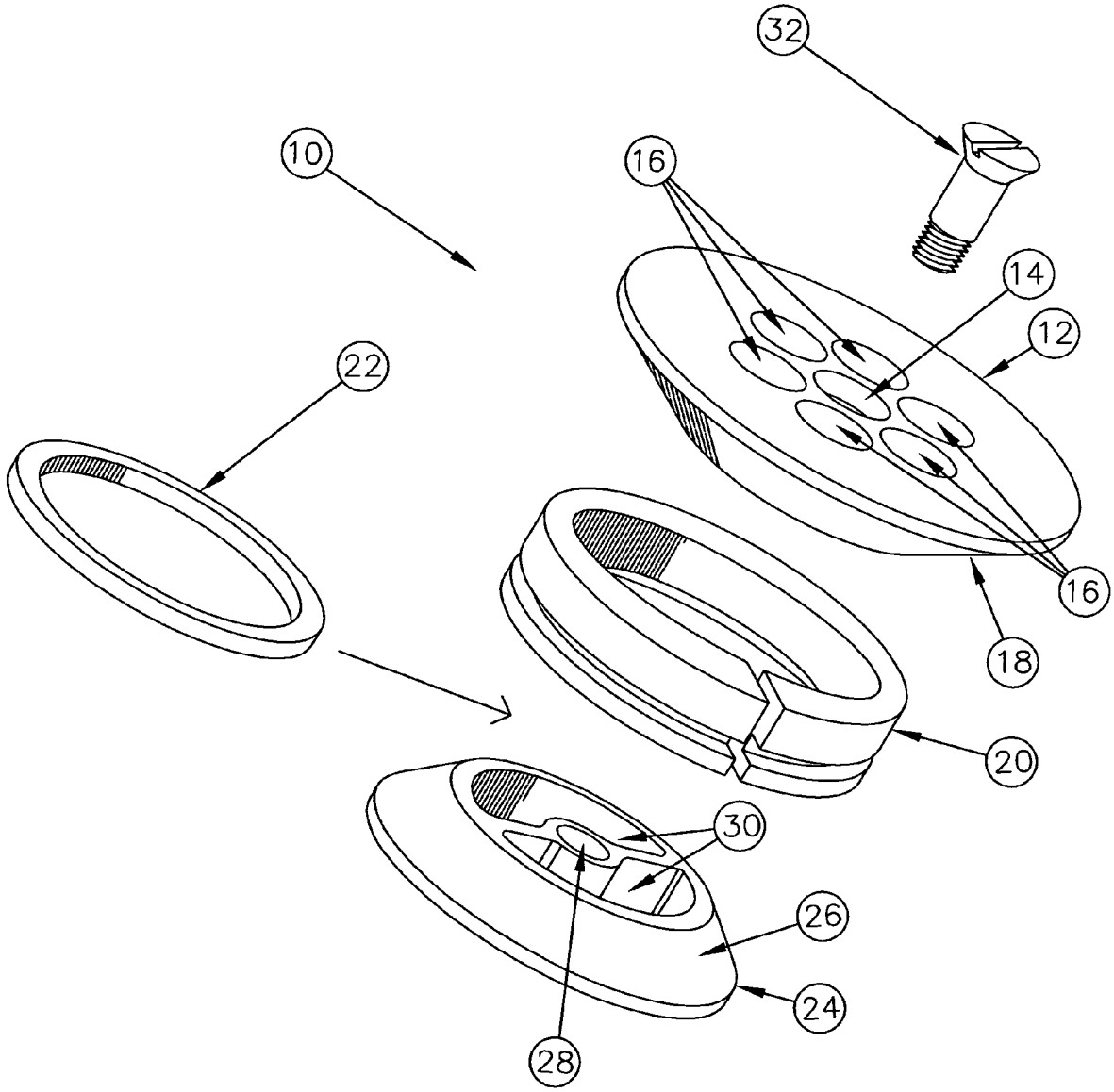
32
10
16
14
12
22
16
18
20
30
26
24
28

REMOVABLE FLOOR SINK DRAIN LOCK

CROSS REFERENCE TO RELATED APPLICATION

This application claims priority to Provisional Patent Application Ser. No. 61/131,136, filed Jun. 6, 2008.

FIELD OF INVENTION

This invention relates to plumbing devices and is particularly directed to improved means for blocking drain openings to prevent passage of large objects, while allowing free flow of fluid therethrough.

PRIOR ART

As is well known, food preparation kitchens are usually provided with a floor sink having a drain opening which connects to a grease trap or sewer to allow disposal of indirect waste water and the like. Unfortunately, rags, napkins, silverware and other large objects are often washed into the floor sink along with the floor washing water and these objects often get carried into the drain and cause blockage, flooding and other problems. Moreover, the loss of napkins, silverware and the like add significant expense to the operation of the restaurant. Unfortunately, most floor sinks have open drains which are subject to the problems noted above. Some prior art drain plugs or screens have been provided which are permanently installed in the drain opening. However, these often become clogged and simply add to the flooding problem. Thus, none of the prior art sink drain plugs have been entirely satisfactory.

These disadvantages of the prior art are overcome with the present invention and an improved floor sink drain plug is provided which positively precludes passage of large objects, while permitting free passage of fluid and which can quickly and easily be removed for cleaning, when desired by means of a special locking key.

These advantages of the present invention are preferably attained by providing an improved floor sink drain screen lock having expandable means for sealingly engaging the walls of a floor sink drain, yet being readily collapsible for quick and easy removal when desired.

Accordingly, it is an object of the present invention to provide an improved floor sink drain screen locking apparatus.

Another object of the present invention is to provide an improved floor sink drain screen lock which positively precludes passage of large objects.

A further object of the present invention is to provide an improved floor sink drain screen lock which positively precludes passage of large objects while permitting free passage of liquids.

An additional object of the present invention is to provide an improved floor sink drain screen lock which positively precludes passage of large objects while permitting free passage of liquids and which can quickly and easily be removed for cleaning, when desired.

A specific object of the present invention is to provide improved floor sink drain screen locks having expandable means for sealingly engaging the walls of a floor sink drain, yet being readily collapsible for quick and easy removal when desired.

These and other objects and features of the present invention will be apparent from the following detailed description, taken with reference to the figures of the accompanying drawing.

BRIEF DESCRIPTION OF THE DRAWING

FIG. 1 is an exploded isometric view of a floor sink drain screen lock embodying the present invention.

DETAILED DESCRIPTION OF THE INVENTION

In that form of the present invention chosen for purposes of illustration, FIG. 1 shows a floor sink drain screen lock, indicated generally at 10 comprising a metal upper disc 12 formed with a central opening 14 surrounded by a plurality of additional openings 16 and having a tapered underside 18, together with a flexible split ring 20, a resilient ring 22 encircling said split ring 20, and a metal lower disc 24 having a tapered upper surface 26 and an internally threaded central opening 28, surrounded by additional openings 30. A bolt 32 is inserted through the central opening 14 of the upper disc 12 and through split ring 20 and resilient ring 22 and threadedly engages the opening 28 in the lower disc 24. Preferably the resilient ring 22 is square in cross section as this permits greater frictional engagement with the walls of the drain opening.

In use, the floor sink drain screen lock 10 is inserted into the mouth of a floor sink drain so that the tapered lower surface 18 of the upper disc 12 rests on the periphery of the floor sink drain opening. The bolt 32 is then tightened which serves to draw the lower disc 24 toward the upper disc 12, which compresses the split ring 20 and resilient ring 22 causing them to expand laterally to frictionally and sealingly engage the wall of the floor sink drain opening. This ensures that the drain screen lock 10 will not be displaced during use. When the floor is washed, water can flow through openings 16 in the upper disc 12 and openings 30 in the lower disc 24. However, any large objects will be blocked by the remaining structure of the upper disc 12. If the openings 16 or 30 become clogged over time, bolt 32 can be loosened, allowing split ring 20 and resilient ring 22 to contract and, hence, allowing the drain screen lock 10 to be removed for cleaning. The resilient ring 22 serves to retain the split ring 20 in position between the upper disc 12 and lower disc 24 when the drain screen lock 10 is not inserted into a drain opening. Subsequently, the drain screen lock 10 can be reinserted in the floor sink drain opening in the manner described above for further use.

Obviously, numerous variations and modifications can be made without departing from the spirit of the present invention. Therefore, it should be clearly understood that the forms of the present invention described above and shown in the accompanying drawing are illustrative only and are not intended to limit the scope of the present invention.

What is claimed is:

1. A floor sink drain screen lock comprising: an upper disc formed with a central opening surrounded by a plurality of additional openings, an expandable split ring, a resilient ring encircling said split ring, a lower disc formed with a central internally threaded opening surrounded by a plurality of additional openings, and a bolt extending through the central opening of said upper disc and threadedly engaging the central opening of said lower disc.

2. The drain screen lock of claim 1 wherein said upper disc is formed with a tapered lower side.

3. The drain screen look of claim 1 wherein said lower disc is formed with a tapered upper surface.

4. The drain screen lock of claim 1 wherein said resilient ring is square in cross section.

5. The drain screen lock of claim 1 wherein said discs are formed of metal.

6. The drain screen lock of claim 1 wherein said split ring is formed of flexible material.

7. The drain screen lock of claim 1 wherein said bolt is tamperproof.

* * * * *